United States Patent [19]

Johnson et al.

[11] Patent Number: 4,516,287

[45] Date of Patent: May 14, 1985

[54] ANGLED ROLLER MOP

[75] Inventors: Robert S. Johnson; Paul E. Fletcher; William S. Benjamin, all of Seattle; John I. Zsitvay, Mercer Island, all of Wash.

[73] Assignee: The Lighthouse for the Blind, Incorporated, Seattle, Wash.

[21] Appl. No.: 595,710

[22] Filed: Apr. 2, 1984

[51] Int. Cl.[3] ..... A47L 13/144

[52] U.S. Cl. ..... 15/119 A

[58] Field of Search ..... 15/116 A, 119 A

[56] References Cited

U.S. PATENT DOCUMENTS

| | | | |
|---|---|---|---|
| 2,201,079 | 5/1940 | Camden | 15/119 A |
| 2,203,106 | 6/1940 | Rogers | 15/119 A |
| 2,210,944 | 8/1940 | McMullin | 15/119 A |
| 2,729,840 | 1/1956 | Rogers | 15/119 A |
| 2,794,198 | 6/1957 | Rogers | 15/119 A |
| 2,887,704 | 5/1959 | Vosbikian et al. | 15/116 A |
| 3,233,269 | 2/1966 | Scheffold | 15/119 A |
| 3,345,667 | 10/1967 | Blum | 15/119 A |
| 3,727,259 | 4/1973 | Wilson | 15/119 A |
| 4,196,488 | 4/1980 | Barry | 15/119 A |

FOREIGN PATENT DOCUMENTS

| | | | |
|---|---|---|---|
| 583434 | 10/1958 | Italy | 15/119 A |
| 413257 | 12/1966 | Switzerland | 15/119 A |

*Primary Examiner*—Edward L. Roberts

*Attorney, Agent, or Firm*—Christensen, O'Connor Johnson & Kindness

[57] ABSTRACT

A roller mop having a wringer assembly connected to a handle and a cleaning element mounted in the wringer assembly for reciprocation through a pair of rollers in a direction that is transverse to the longitudinal axis of the handle. The cleaning element is reciprocated by a retraction rod that has upper and lower arms that are angled relative to one another. The lower arm is oriented to exert a pulling force upon the cleaning element that is directed at an angle relative to the axis of reciprocation. To counteract a nonproductive component of the exerted force that tends to bind the cleaning element, the lower arm is arranged to engage a bearing surface that in included on the wringer assembly.

8 Claims, 8 Drawing Figures

ANGLED ROLLER MOP

BACKGROUND OF THE INVENTION

The present invention relates generally to the brushing, scrubbing, and general cleaning arts. More particularly, the invention concerns a mop of the roller type having a sponge-like cleaning element and a mechanism that is actuated to wring the cleaning element.

In mops of this general type, the wringing mechanism typically includes a pair of rollers mounted to a frame and on opposite sides of the cleaning element. The rollers are spaced closely relative to the normal, fully expanded width of the cleaning element. Wringing is effected by pulling the cleaning element through the rollers to compress the sponge-like material.

It is particularly desirable to employ a dense sponge-like material because of its greater absorbency and durability. Such materials, however, are more difficult to compress and, thus, are difficult to pull between the narrowly spaced rollers.

In recognition of this problem, prior approaches have resorted to the use of a lever that is linked to a clamp that holds the upper end of the cleaning element. A fixed pivot point for the lever is provided on either the handle or the frame that holds the rollers. To wring the cleaning element, the free end of the lever is moved to draw the cleaning element upward between the rollers. The direction of movement of the lever may be either toward or away from the handle, depending upon the arrangement of the linkage that connects the lever to the clamping member. U.S. Pat. No. 2,201,079 to Camden; U.S. Pat. No. 2,203,106 to Rogers; U.S. Pat. No. 2,210,944 to McMullin; U.S. Pat. No. 2,729,840 to Rogers; and U.S. Pat. No. 2,794,198 to Rogers exemplify this type of wringer mop. While there are differences in the approaches of these patents, the lever-based wringer mechanisms commonly employ a number of mechanically linked elements to effect movement of the cleaning element and compression thereof by the rollers. The provision of these multiple parts necessarily adds to the cost of manufacture of the mop, both in terms of cost of materials and labor. Since the components of the wringing mechanism are subjected to stress-inducing forces, the mops disclosed in these references are not well suited for construction from plastic materials. Accordingly, the designs of such mops do not lend themselves to manufacture by economical plastic-molding techniques.

The highly expandable characteristics of the preferred dense cleaning elements have heretofore been an obstacle to the simplification of the mechanism that draws the cleaning element between the pair of closely spaced rollers. Since substantial force is required to draw the element between the rollers, resort has typically been taken to lever mechanisms such as those discussed above. An alternative approach has been to position the axes of the roller on either side of, and in parallel relation to, the longitudinal axis of the handle. In this arrangement, the cleaning element projects outward from the end of the handle and is adapted to be reciprocated in a direction parallel to the longitudinal axis of the mop handle. A simplified push-pull mechanism can thus be employed to effect wringing of the cleaning element. This arrangement is, however, not fully satisfactory. In particular, the main useful surface of the sponge-like cleaning element projects directly outward from the end of the handle. Since the handle is oriented at an angle relative to the floor in a normal position of use, the provision of the cleaning element at the end of the handle necessarily presents less than the full surface of the element to the floor or other surface to be cleaned. Thus, the mop must be turned over frequently during use. As well, this arrangement leads to uneven wear of the cleaning element.

The present invention provides an improved arrangement that overcomes the disadvantages of the developments described above. In particular, the invention provides a simple, reliable, and economical to manufacture retraction mechanism for a roller mop that permits orientation of the cleaning element for reciprocation through the rollers in a direction that is transverse to the longitudinal axis of the handle. Advantageously, this orients the cleaning element at a more usable position relative to the surface to be cleaned when the handle is oriented in a normal position of use.

SUMMARY OF THE INVENTION

In accordance with the invention, there is provided a roller mop having a wringer assembly connected to a handle. The wringer assembly includes a pair of spaced-apart ends having openings that cooperatively define a retraction channel that is open at its lower end and closed at its upper end. A pair of rollers are mounted in parallel relation to one another on opposite sides of the open lower end of the channel. A cleaning assembly having a compressible cleaning element secured to a retainer is mounted for reciprocation in the retraction channel. In this position, the cleaning element extends downwardly between the rollers. The cleaning assembly is moved by a retraction rod along the path provided by the retraction channel between an open position, in which the retainer that holds the cleaning element engages the rollers, and a closed position, in which the retainer engages the closed end of the retraction channel. According to an aspect of the invention, reciprocation of the cleaning element is facilitated by the cooperative, sliding engagement of the retraction rod with a bearing surface that is provided on the wringer assembly at a position adjacent the closed end of the retraction channel. In a preferred form, the bearing surface is positioned longitudinally upward from the closed end of the retraction channel and laterally inward from the retraction axis provided by the retraction channel. It is also preferred that the retraction rod engage the bearing surface at least during the initial portion of its movement of the cleaning assembly.

To orient the lower, working surface of the cleaning element at a more usable position relative to the surface to be cleaned, the retraction channel, and hence the cleaning assembly, is oriented for reciprocation through the rollers in directions that are transverse to the longitudinal axis of the handle. In accordance with another aspect of the invention, movement of the cleaning element in this arrangement is enhanced by configuring the retraction rod with upper and lower arms that are angled in a predetermined manner relative to one another and to the axes of the retraction channel and the handle. In particular, the upper arm extends upwards from the wringer assembly in general alignment with the longitudinal axis of the handle while the lower arm extends downward from the upper arm at a fixed angle relative thereto. The lower arm is connected at its lower end to the retainer of the cleaning assembly and is oriented at predetermined angles relative to both the retraction axis and the longitudinal axis of the handle. To permit easy movement of the cleaning assembly, the bearing surface is constructed and configured to provide minimal frictional resistance to the movement of the retraction rod. Preferably, the bearing surface is an inner surface of an aperture provided in the wringer assembly at a position adjacent the handle and offset laterally inward from the retraction axis. When a wringing force is applied to the upper arm of the retraction rod, the lower arm slides over the inner surface of the aperture in order to direct the pulling force on the cleaning assembly continuously along the retraction axis and, as well, to prevent twisting of the cleaning element in an inward, rolling manner.

In accordance with a further aspect of the invention, the force-directing and stabilizing function of the angled arm arrangement of the retraction rod is further enhanced by torsionally biasing the lower arm in a direction outward from the handle.

BRIEF DESCRIPTION OF THE DRAWINGS

The invention can be understood by the following portion of the specification taken in conjunction with the accompanying drawings in which.

DETAILED DESCRIPTION OF THE INVENTION

Figure 1:
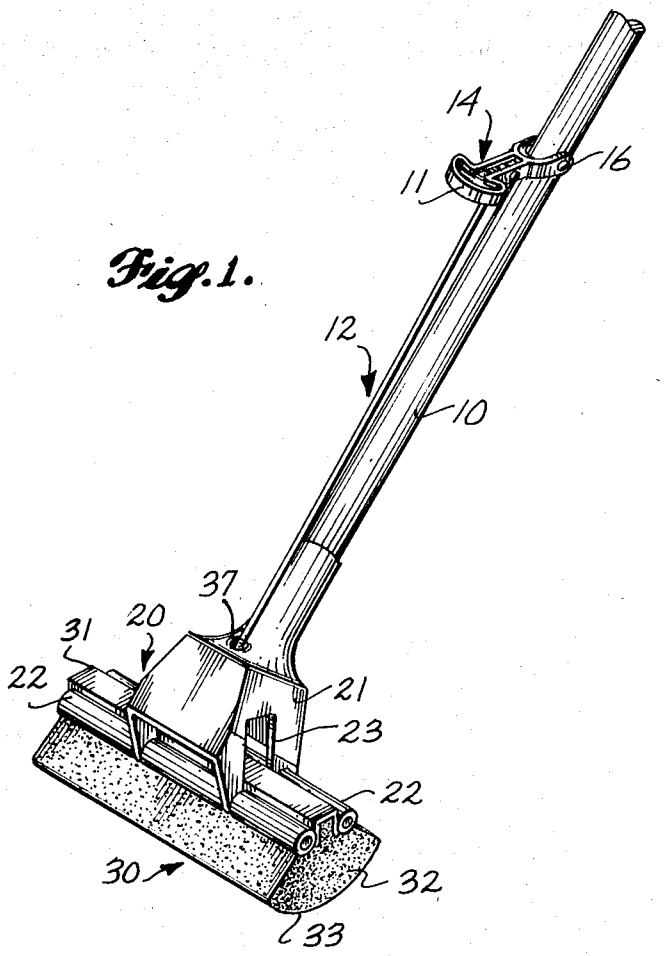
FIG. 1 is a perspective view of a mop according to the invention.

Referring to FIG. 1, a mop according to the invention includes an elongate handle 10 that is circular in cross-sectional dimension. For clarity of illustration, the upper end of the handle has been cut away. It will be readily understood that the handle will have a suitable length that will permit comfortable operation. A wringer assembly 20 is securely connected to the lower end of the handle and has, at its lower end, a pair of roller assemblies 22. A cleaning assembly 30 is mounted for reciprocation in the wringer assembly and includes a compressible, expansible, porous cleaning element 32 that extends between the two roller assemblies 22. A retraction rod 12 is connected at its lower end to the cleaning assembly 30 and at its upper end to an actuating mechanism 14 that is pivotally connected to the handle 10. When wringing of the cleaning element 32 is desired, the actuating mechanism 14 is pulled in an upward direction that is generally along the handle 10. This provides a force that pulls the cleaning element upward between the roller assemblies 22. To return the cleaning element to the working position, the actuating mechanism is pushed downward along the handle.

As seen in FIG. 1, and understood more clearly from FIGS. 2 through 5, the wringer assembly 20 has a pair of opposed sides 21 that are mirror images of one another and disposed symmetrically about the longitudinal axis of the handle 10. Each side has a rectangular slot 23 that is open at the lower end. The edges of the slots 23 are oriented to cooperatively define a parallel-sided retraction channel that is designated 24 in FIG. 2. The roller assemblies 22 are mounted in parallel relation to one another on opposite sides of the open ends of the slots 23. In preferred form, each roller assembly has three distinct rollers 25 that are secured to a rod 26 for synchronous rotation. Preferably, the rollers 25 are constructed from a resilient material that is hard enough to retain its shape while compressing the cleaning element 32 but soft enough to allow a slight expansion of the bores of the rollers in order to permit insertion of the rod 26 serially through the rollers and through holes that are provided in the sides 21. When so joined, the rollers 25 tightly grip the rod 26 to form the roller assemblies 22. The holes in the sides 21 are dimensioned so that the roller assemblies 22 are journalled therein and, thus, rotate freely when the cleaning element is drawn therebetween.

Figures 2, 6, 7, 8:
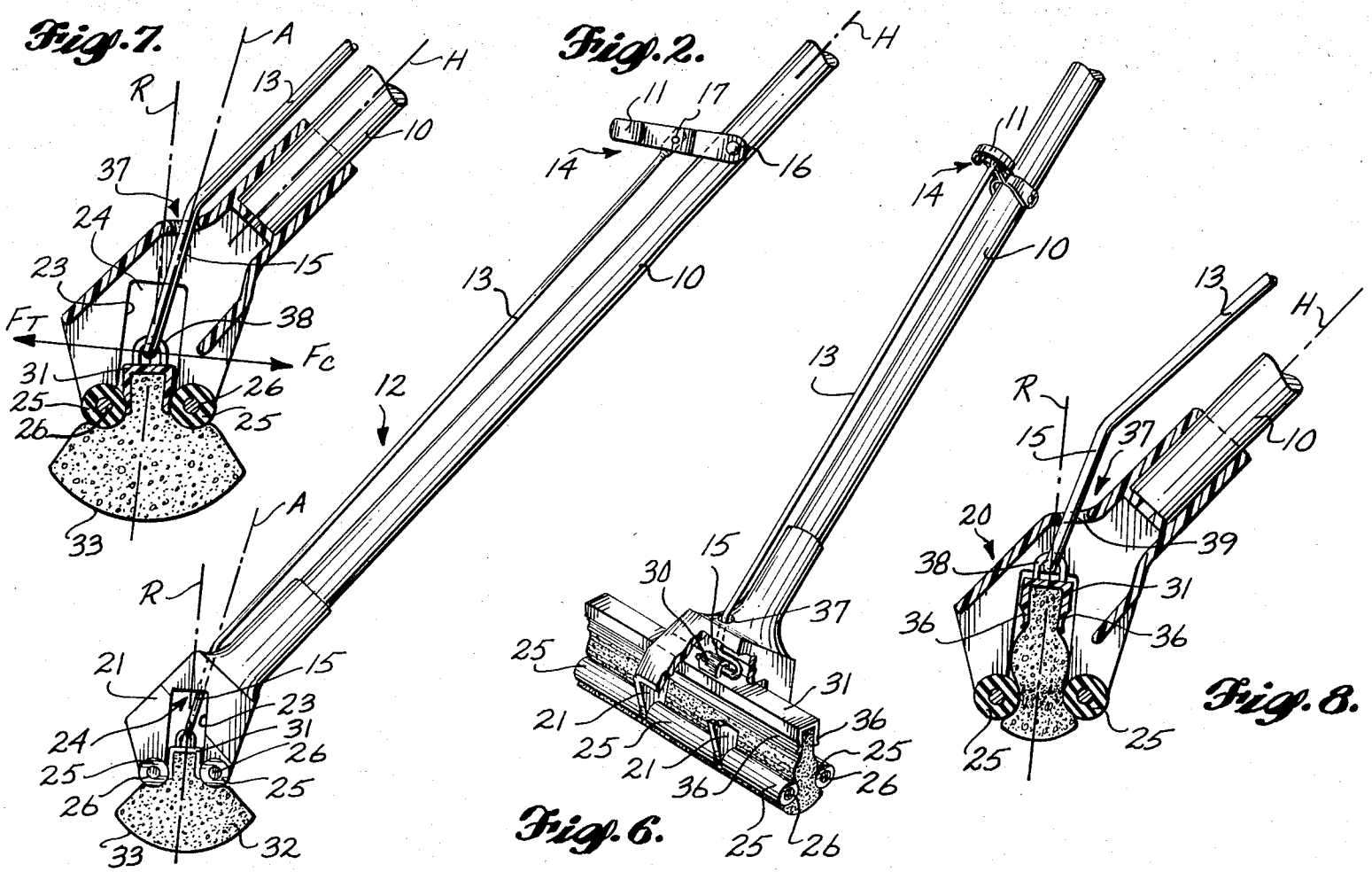
FIG. 2 is a side elevation view.
FIG. 6 is a perspective view similar to the view of FIG. 1 with parts broken.
FIG. 7 is an enlarged sectional view taken along line 7—7 of FIG. 3, and showing the cleaning element in the open, working position.
FIG. 8 is an enlarged sectional view along line 7—7 of FIG. 3, but showing the cleaning element in the fully closed position.
Figure 3:
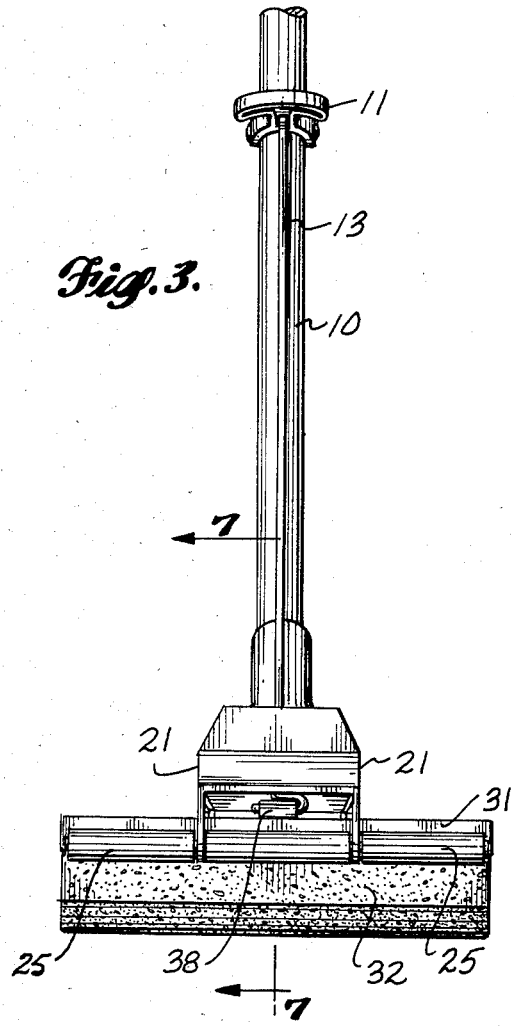
FIG. 3 is a front elevation view.
Figure 4:
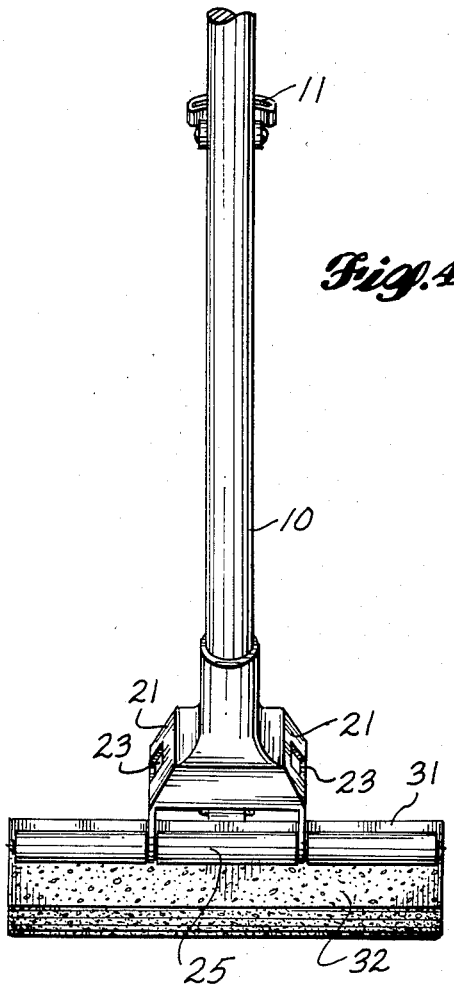
FIG. 4 is a rear elevation view.
Figure 5:
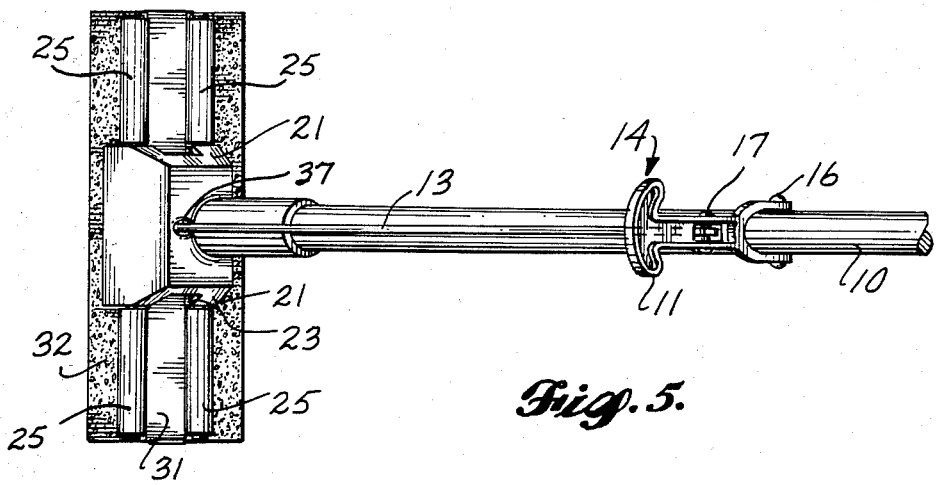
FIG. 5 is a plan view.

With reference to FIGS. 1 and 2, the cleaning element 32 has an arcuate lower surface 33 and front and rear faces 34 and 35, respectively, that taper inwardly and upwardly. The upper portion of the cleaning element is tightly secured across its entire width within the recess of a channel-shaped retainer 31. For a tight connection, the retainer 31 is dimensioned so that the cleaning element is compressed substantially in a clamping fashion. For added protection against separation, it is preferred that a suitable adhesive be used to join the cleaning element and retainer. As seen best in FIGS. 6 and 8, each of the depending sides of the retainer has a shallow, rounded groove 36 that extends across the entire width of the retainer. When the cleaning assembly is positioned in the open, or cleaning position shown in FIG. 7, the grooves 36 engage the rollers 25. This holds the cleaning assembly in a stable position and prevents its separation from the wringer assembly.

To provide optimum performance and long life, it is preferred that the cleaning element be constructed of a high-density sponge-like material that is compressible, expandable, and porous. A wide variety of materials meeting these criteria are available, as will be appreciated by those skilled in this art. Polyether synthetic sponge material is particularly well suited. The flared shape of the cleaning element advantageously provides a large, useful cleaning surface. As will be seen with reference to FIGS. 7 and 8, the cleaning element is compressed substantially as it is drawn upwards between the rollers. A fairly substantial force must be exerted to pull the cleaning element upwards through the rollers. In an attempt to direct this pulling force along the path of travel of the cleaning assembly, prior approaches have either employed costly combinations of levers and linkages or have oriented the axis of reciprocation of the cleaning assembly in a plane on or parallel to the longitudinal axis of the handle. As noted earlier, this latter arrangement undesirably orients the cleaning element in a difficult-to-use and wear-inducing position.

In contrast to these approaches, the present invention permits reciprocation of the cleaning element along a path that is more usefully oriented in transverse relation to the handle, while also enabling simplification of the mechanism that effects that reciprocation. In simplest form, this is achieved through the use of a single retracting rod that is connected at its lower end to the cleaning assembly and is pulled upwardly at its upper end in a direction that is generally parallel to the handle axis. To translate the exerted force into an upward pulling force on the cleaning assembly, the retraction rod has a lower arm that is angled laterally downward from an upper arm segment. The lower arm is positioned at an offset angle from the direction of movement of the cleaning assembly. Accordingly, the pulling force that is exerted by the rod is in a direction that is oriented at angles relative to the direction of movement of the cleaning assembly. As a result of this arrangement, a component of the exerted force exists in a "nonpulling" direction that is transverse to the direction of reciprocation. This force tends to rotate the cleaning assembly inwardly such that the retainer 31 binds within the retraction channel 24. This makes it difficult to pull the cleaning assembly through the rollers and, thus, negates the advantages sought to be obtained by a redirection of the pulling force. To prevent this tendency to bind, the present invention provides a bearing surface, which counteracts the "nonpulling" force component. The bearing surface also provides a smooth surface over which the lower arm of the rod may easily slide during a portion or all of its movement of the cleaning assembly. The cooperative interaction between the rod and the bearing surface thus insures ease of operation of the mop.

This can be better understood with reference to FIGS. 2, 7, and 8. The sides of the retainer 31 are guided by the edges of the slots 23 so that the cleaning assembly moves within the retraction channel 24 along a centrally located retraction axis designated R. As will be seen, this retraction axis is oriented at an angle relative to the longitudinal axis H of the handle. As seen in FIG. 2, the retraction rod 12 has an upper arm 13 and, extending downwardly therefrom and at an angle thereto, a lower arm 15. With reference to FIG. 7, the lower arm is oriented along an arm axis A that lies at angles to both the retraction axis R and the handle axis H. The lower end of the lower arm 15 is configured as a hook that is inserted through a tunnel-shaped eyelet 38, which is centrally located on the upper surface of the retainer 31 (see FIG. 6). The retraction rod 12 is configured of a rigid material so that the angular relationship between the upper and lower arms is maintained. Metallic rods are particularly well suited for this purpose and are easily shaped to provide the necessary configuration. Referring again to FIGS. 2 and 7, when the upper arm 13 is pulled in an upward direction by the actuating mechanism 14, this pulling force is directed upwards along the arm axis A. The working component of this exerted force is directed upwards along the retraction axis R. A counterproductive component of the exerted force is directed inwardly against the eyelet 38 in the direction of the arrow labelled $F_C$ in FIG. 7. As discussed above, this force tends to rotate the cleaning assembly inwardly into binding engagement with the sides of the slots 23, making it difficult to pull the cleaning element through the rollers. To counteract this force, and thus permit facile reciprocation of the cleaning assembly, the lower arm 15 engages a bearing surface 39 on the inner face of an aperture 37. It will be appreciated that the bearing surface provides a force that opposes the counterproduction force $F_C$. In the open position shown in FIG. 7, the lower arm is in contact with the bearing surface. From this initial position, the lower arm slides upwards along bearing surface 39, preferably during a substantial portion of its movement of the cleaning assembly. As the cleaning assembly nears the closed position shown in FIG. 8, the lower arm 15 lifts away from the bearing surface 39. In order to avoid inhibiting the movement of the lower arm, the aperture 37 is dimensioned so that the lower arm does not engage the opposite face of the aperture, i.e., the inner face of the aperture that lies opposite the bearing surface 39. As noted below, plastic construction is preferred for the wringer assembly. Such construction is particularly advantageous for providing a good, sliding bearing surface for a metallic retraction rod.

It will be observed that the cleaning element binding problem is present in all arrangements in which the applied pulling force is translated through an angle by the retraction rod and exerted as a pulling force upon the cleaning assembly. The inventive arrangement of the bearing surface will provide a solution to the binding problem for any such arrangements. It is to be noted that this problem would also be presented in an arrangement in which the upper arm of the retraction rod is positioned differently, relative to the handle, than is shown and described herein. For example, such a problem could be presented where the rod is positioned "below" the handle, or within the interior of a hollow handle.

To further counteract the counterproductive force component $F_C$, the lower arm 15 optionally may be torsionally biased outward at its lower end to provide a force component in the direction of the arrow labelled $F_T$ in FIG. 7. With the preferred metallic construction, this optional biasing is readily provided by orienting the lower arm 15 relative to the upper arm 13 so that a slight additional amount of bending inwards is required to slip the hook on the lower end of the arm 13 into the eyelet 38. It is to be noted that the degree of further bending needed to provide suitable biasing is not so great as to render it difficult to reverse the process in order to replace the cleaning assembly 30.

Various mechanisms may be employed to exert an upwards pulling force on the upper arm 13 of the retraction rod. The preferred actuating mechanism 14 provides an efficient, economical-to-manufacture means for exerting a pulling force on the upper arm in a direction that substantially parallels the axis of the handle. By suitable selection of the length of the upper arm 13, the actuating mechanism may be positioned at a convenient, easy to operate position on the handle. Unlike prior mops that have levers that must be pivoted outward through a substantial path of travel, the present arrangement effects the wringing action with a fairly short stroke that travels close to the handle. To accomplish this, the actuating mechanism 14 includes a lever 11 that is pivotally connected to the handle 10 by means of a pin 16. Preferably, lever 11 and pin 16 are connected in fixed relation and, in turn, pin 16 is journalled for rotation within a through-hole provided in handle 10. A cross-pin 17 spans the width of an aperture 18 in lever 11, as seen best in FIG. 5. This pin passes through, and is journalled in, a hole that is provided in the end of the upper arm 13 of the retraction rod. The hole in the upper arm 13 is suitably sized so that this arm and the cross-pin 17 are free to rotate relative to one another. For ease of operation, the outer end of the lever spreads into an easy-to-grasp handle.

In addition to the cost savings realized through simplification of the actuating mechanism, the present invention enables cost-effective manufacture using plastic-forming techniques. In particular, with the exception of the roller assemblies 22, the wringer assembly 20 may be injection molded as a single piece. Similarly, the retainer 31 of the cleaning assembly and the lever 11 are easily manufactured by injection molding. Since the mop is easily assembled from the component parts, manufacturing costs attributable to labor are also reduced. In this regard, assembly merely requires connecting the lever to the retraction rod 12 and to the handle 10, inserting the handle 10 in form-fitting relation into the provided receptacle in wringer assembly 20, mounting the rollers 25 and rods 26, and sliding the cleaning assembly 30 through the rollers and into connection with the hook on the lower arm 15 of the retraction rod.

The present invention has been described in relation to its preferred embodiments. One of ordinary skill, after reading the foregoing specification, will be able to effect various changes and substitutions of equivalents without departing from the broad concepts disclosed herein. It is therefore intended that the protection afforded by Letters Patent granted hereon be limited only by the definition contained in the appended claims and equivalents thereof.

The embodiments of the invention in which an exclusive property or privilege is claimed are defined as follows:

1. A mop, comprising:

an elongate handle having a longitudinal axis;

a wringer assembly connected to said handle, said assembly including:

a pair of spaced-apart ends, each of said ends having openings that cooperatively define a retraction channel that is oriented about a retraction axis, said channel being open at its lower end and closed at its upper end, said retraction axis being oriented transverse to the longitiudinal axis of said handle;

a pair of rollers mounted between said ends in substantially parallel relation to one another on opposite sides of the open lower end of said channel; and a bearing surface disposed adjacent the closed end of said retraction channel;

a cleaning assembly having a compressible cleaning element connected to a retainer, said cleaning assembly being mounted in the retraction channel so that said cleaning element extends downwardly between said rollers, said cleaning assembly being adapted to move along the retraction axis in a transverse direction relative to the longitudinal axis of said handle between an open position, in which the retainer of said cleaning assembly engages said rollers, and a closed position, in which said retainer engages the closed end of said channel; and a retraction rod connected to the retainer of said cleaning assembly, said rod being operable to move the cleaning assembly in said retraction channel in a transverse direction relative to the longitudinal axis of said handle, said rod having an angled portion that is adapted to slidingly engage said bearing surface during a portion of the movement of the cleaning assembly between the open and closed positions.

2. The mop of claim 1, wherein said bearing surface is offset from said retraction axis.

3. The mop of claim 2, wherein said bearing surface is positioned laterally inward from said retraction axis and longitudinally upward from the closed end of said retraction channel.

4. The mop of claim 3, wherein the angled portion of said rod engages said bearing surface during at least the initial portion of its movement of the cleaning assembly.

5. The mop of claim 4, wherein the angled portion of said rod engages said bearing surface during a substantial portion of its movement of the cleaning assembly.

6. The mop of claim 2, wherein said rod has upper and lower arms, said upper arm extending upwards from said wringer assembly, said lower arm extending downward from said upper arm at a predetermined fixed angle relative thereto, said lower arm being connected at its lower end to the retainer of said cleaning assembly and oriented at predetermined angles relative to said retraction axis and the longitudinal axis of said handle, said lower arm being adapted to slidingly engage said bearing surface.

7. The mop of claim 6, wherein said wringer assembly includes an aperture positioned upwards from said retraction channel and adjacent said handle, an inner surface of said aperture comprising said bearing surface, the lower arm of said retraction rod being disposed within said aperture.

8. The mop of claim 6, wherein said lower arm is torsionally biased at its lower end in a direction outward from said handle to apply an outwardly directed force to the retainer of said cleaning assembly.

* * * * *

UNITED STATES PATENT AND TRADEMARK OFFICE

CERTIFICATE OF CORRECTION

PATENT NO. : 4,516,287

DATED : May 14, 1985

INVENTOR(S) : Robert S. Johnson et al.

It is certified that error appears in the above-identified patent and that said Letters Patent is hereby corrected as shown below:

Abstract, line 13: "in" should be --is--
Column 7, line 34: "longitiudinal" should be --longitudinal--

Signed and Sealed this

*Tenth* Day of *December 1985*

[SEAL]

*Attest:*

DONALD J. QUIGG

*Attesting Officer*

*Commissioner of Patents and Trademarks*